United States Patent [19]

Nakamura

[11] Patent Number: 4,696,080

[45] Date of Patent: Sep. 29, 1987

[54] METALLIC WIRE FOR SPINNING MACHINERY AND THE METHOD OF MANUFACTURING THE SAME

[75] Inventor: Ritsuji Nakamura, Daito, Japan

[73] Assignee: Kanai Juyo Kogyo Kabushiki Kaisha, Hyogo, Japan

[21] Appl. No.: 814,722

[22] Filed: Dec. 30, 1985

[51] Int. Cl.[4] ..... D01G 15/12

[52] U.S. Cl. ..... 19/114; 148/147

[58] Field of Search ..... 148/145, 146, 147; 219/121 L, 121 LM; 140/97; 72/342; 19/98, 113, 114

[56] References Cited

U.S. PATENT DOCUMENTS 2,422,561 6/1947 Pavitt ..... 148/147

2,786,788 3/1957 Anderson ..... 148/147

FOREIGN PATENT DOCUMENTS 106724 7/1982 Japan ..... 148/147

*Primary Examiner*—Lowell A. Larson

*Attorney, Agent, or Firm*—Wenderoth, Lind & Ponack

[57] ABSTRACT

Metallic wire for spinning machinery has improved wear resistance of its teeth portion, which results in an improved grinding cycle and in an improved service life of the metallic wire. The wire has a quench hardened part on the whole teeth portion (except the valley bottom parts) which is formed by applying laser beams to the teeth portion according to the method of manufacturing the metallic wire for spinning machinery according to the present invention.

3 Claims, 7 Drawing Figures

METALLIC WIRE FOR SPINNING MACHINERY AND THE METHOD OF MANUFACTURING THE SAME

BACKGROUND OF THE INVENTION

1. Field of the Invention

This invention relates to metallic wire to be used for spinning machinery, etc. and the method of manufacturing the same.

2. Description of the Prior Art

The conventional metallic wire 1 for spinning machinery which is made of hard drawn steel wire or alloy steel wire has a quench hardened part 2*a* at the top of each tooth (about 20–50% of the tooth height h) of a teeth portion 2, as shown in FIG. 5A and FIG. 5B, for the purpose of preventing wear of the teeth portion 2 due to frictional contact with fiber. The quench hardening is accomplished by the flame quench hardening method. However, under the severe operating conditions in spinning mills in recent years, higher abrasion resistance has been required for metallic wire. In order to meet such requirements, there is metallic wire which is hardened to a high degree and has a wide range of the quench hardened part 2*a*, as shown in FIG. 6. However, if flame hardening is applied deeply, hardening occurs down to a valley bottom part 3, namely, the hardened part 2*a* ranges from the teeth portion 2 to the under part of the valley bottom part 3. Therefore, hardness of the valley bottom part 3 becomes higher and this results such troubles as the difficulty of winding metallic wire around a roller and cracking of the valley bottom part 3, with resultant cutting of metallic wire.

An object of the present invention is to eliminate the demerits of conventional metallic wire for spinning machinery which and to provide spinning wire that has high hardness (excepting the valley bottom part), improved wear resistance, longer service life and prolonged grinding cycle, together with a method of manufacturing such metallic wire.

SUMMARY OF THE INVENTION

Metallic wire according to the present invention for spinning machinery is characterized in that it is made of hard drawn steel wire or alloy steel wire and is quench hardened throughout the whole teeth portion, except a valley bottom part. A boundary at the bottom of the quench hardened part has a downward and substantially circular arc shape.

A method of manufacturing metallic wire according to the present invention is characterized in that firstly hard drawn steel wire or alloy steel wire is rolled into the specified cross-sectional shape, which is punched to obtain the desired teeth portion and is then subjected to a pre-treatment such as an annealing treatment or a chemical conversion treatment, and finally the teeth portion as a whole, except a valley bottom part, is quench hardened by applying laser beams to the substantially central part of the sides of the teeth portion, followed by heating and quenching, and a boundary at the bottom of the quench hardened part is formed to have a downward and substantially circular arc shape.

BRIEF DESCRIPTION OF THE DRAWINGS

The nature and advantages of the present invention will be understood more clearly from the following description made with reference to the accompanying drawings, in which:

FIG. 2 and FIG. 3 show a comparison between the metallic wire for spinning machinery according to the present invention and the conventional metallic wire, in which FIG. 2 is a graph showing respective curves of section hardness distribution and FIG. 3 is a graph showing respective curves of the relation between the number of neps and the output;

FIG. 5 shows a conventional metallic wire, in which

DETAILED DESCRIPTION OF THE INVENTION

Embodiment 1 of the present invention is described below with reference to the accompanying drawings.

Figure 1:
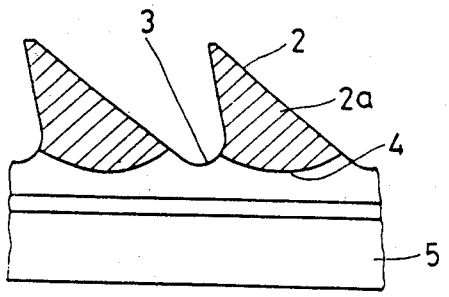
FIG. 1 is a front view of a main part of the metallic wire; for spinning machinery, of Embodiment 1 of the present invention, showing a quench hardened portion.

Embodiment 1:

Metallic wire for spinning machinery according to the present invention is made of high carbon steel wire rod. As shown in FIG. 1, a teeth portion 2 (a valley bottom part 3) has a quench hardened part 2*a* of more than Vickers hardness Hv 740 and a lower boundary 4 of the quench hardened portion 2*a* is has a substantially circular arc shape.

An explanation is made below about the method of manufacturing metallic wire for spinning machinery according to the present invention.

High carbon steel wire rod having an edge portion 5 is punched to form the desired teeth portion 2. Then, laser beams are applied to the central part of the sides of the teeth portion 2 under the following laser hardening conditions, by a $CO_2$ gas laser Output: 100–500 W Mode: Single mode or multi-mode Beam diameter: $\phi$05–50 mm Focal distance of lens: 25–200 mm and only the teeth portion 2 is heated in a short time to a temperature higher than the austenitizing temperature and is quenched by rapid heat conducting to the edge part. By this treatment, the teeth portion 2 as a whole obtains a uniform and fine martensite structure and the lower boundary of the quench hardened portion is formed to have a downward and substantially circular arc shape. Thus, metallic wire according to the present invention is manufactured. Quenching can be done by compulsory cooling.

The conventional metallic wire for spinning machinery made of high carbon steel wire rod and flame hardened, in comparison with the metallic wire A for spinning machinery made according to the above method, was examined for a section hardness distribution at the teeth portion. Curves of the section hardness distribution of A and B were as shown by FIG. 2.

Figure 2:
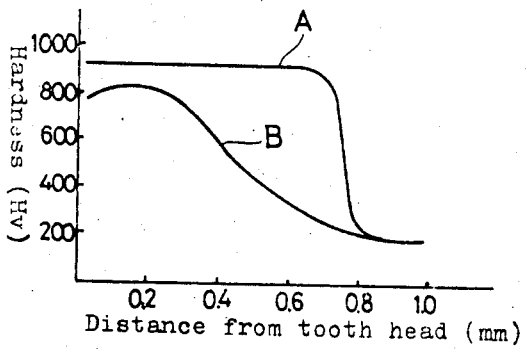

As is obvious from FIG. 2, metallic wire A according to the present invention has hardness of Hv 950 at its teeth portion. The teeth portion as a whole (tooth height of embodiment: 0.8 mm) is hardened uniformly and the hardness distribution at the tooth bottom is as low as around Hv 200. It was found that as compared with the conventional metallic wire B, the metallic wire A has a quench hardened part which has a uniform high hardness throughout the teeth portion (except a tooth bottom part).

Figure 3:
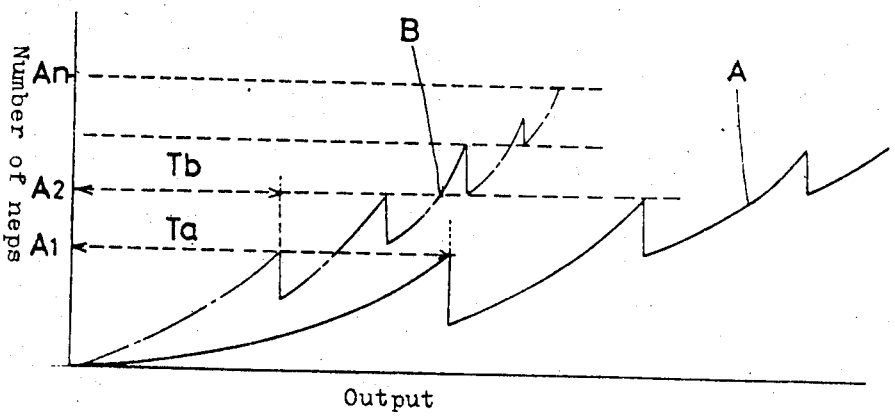

A comparative test of the metallic wire A according to the present invention and the conventional metallic wire B, each wound round a cylinder roller, for carding operation was carried out, with the result as shown by FIG. 3. In this carding test, a tooth head was ground to renew its sharpness upon reaching the specified number of neps $A_1$, $A_2$ and the test was continued until the allowable limit of the number of neps An was reached.

As can be seen from FIG. 3, the grinding cycle Ta of the metallic wire A according to the present invention was longer than the grinding cycle Tb of the conventional metallic wire B and that the metallic wire A showed a much longer service life then the conventional metallic wire B.

Figure 4:
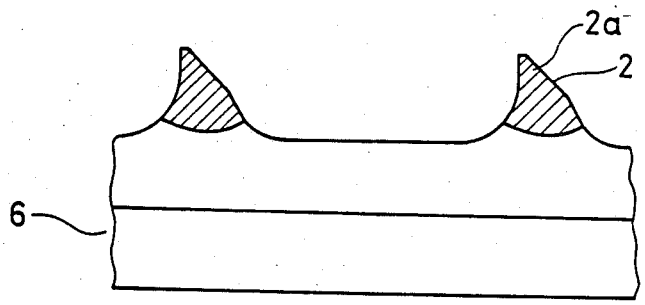
FIG. 4 is a front view of a main part of Embodiment 2.
Figure 5A:
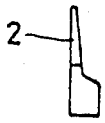
FIG. 5A is a side view and FIG. 5B is a front view.
Figure 5B:
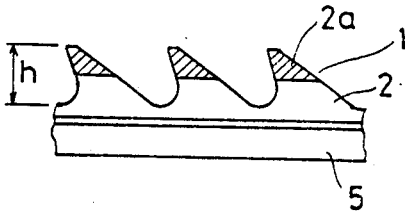
Figure 6:
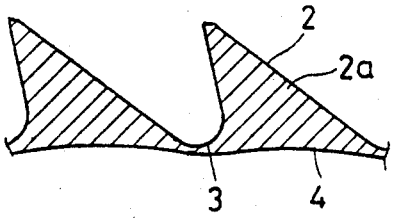
FIG. 6 shows a teeth portion of conventional metallic wire, on an enlarged scale, which is quench hardened.

Embodiment 2:

FIG. 4 shows another embodiment of the present invention, namely, metallic wire according to the present invention as applied to a combing wire 6 to be used on a combing roller of open-end spinning machine.

The combing wire 6 is made by rolling alloy steel wire such as high carbon chrome steel, tool steel, heat resisting steel, etc. into the desired cross sectional shape and is punched to form the desired teeth portion 2, shape, which is punched to form the desired teeth portion 2, is subjected to a pre-treatment such as an annealing treatment or a chemical conversion treatment, and is subjected continuously to laser beams to form a quench hardened portion 2*a* having a lower boundary which is formed to have a downward and substantially circular arc shape.

In the case of the metallic wire according to the present invention, it is possible to remove processing stress imparted by rolling and also to improve absorption of the energy of the laser beams by annealing the metallic wire in the atmosphere or by chemically treating the wire as a pre-treatment prior to laser quenching.

The manufacturing method according to the present invention is applicable to cylinder wire, taker-in wire, and combing wire, by changing the laser quenching conditions.

In the metallic wire according to the present invention, since only the teeth portion is heated by the high power laser beams after application of a pre-treatment such as an annealing treatment or a chemical conversion treatment, heating is done in a short time and quenching can be effected by self-cooling. As the metallic wire according to the present invention has a uniform quench hardened portion having a high hardness, it has improved wear resistance at its teeth portion and has a prolonged grinding cycle and a longer service life.

Although its teeth portion as a whole has a quench hardened part of high hardness, hardness of its valley hardened part of high hardness, the boundary at the bottom of the quench hardened part has a downward and substantially circular arc shape and therefore hardness at the valley bottom part is low and when winding metallic like, winding is done easily and there is no danger of the metallic wire being cut off while being wound.

According to the method under the present invention, as quench hardening can be done in the atmosphere without using a vacuum device and also can be done by abrupt heating and abrupt cooling at the sides of a teeth portion, a quench hardened part having a high hardness is provided at each tooth portion, excepting a valley bottom part, uniformly and free from adhering of oxidised steel. Thus, quality and productivity of metallic wire can be improved to a large extent.

What is claimed is:

1. Metallic wire for spinning machinery, said metallic wire comprising:

hard drawn steel wire or alloy steel wire having a plurality of quench hardened teeth spaced apart from one another by respective valley parts; and said wire having boundaries defined thereon extending between adjacent ends of the valley parts at respective roots of the teeth which are arcuate and convex away from the teeth, said quench hardened teeth being on one side of the boundaries, and the valley parts being on the other side of said boundaries and having a hardness which is less than the hardness of said quench hardened teeth.

2. Metallic wire as claimed in claim 1, wherein said quench hardened teeth have a uniform hardness between Hv 740 and Hv 950, and said valley parts have a hardness of approximately Hv 200.

3. A method of manufacturing metallic wire for spinning machinery, said method comprising:

rolling hard drawn steel wire or alloy steel wire to provide the wire with a predetermined cross-sectional shape;

forming teeth on the rolled wire that are spaced apart from one another by respective valley parts by punching the rolled wire;

pretreating the wire with chemicals or by annealing to increase the energy absorption capability of the wire;

subsequently applying energy to a central part of the sides of the teeth by applying laser beams to the central part of the sides of the teeth to heat only the teeth over their entirety; and subsequently cooling the wire rapidly thereby only quench hardening the teeth of the wire over their entirety so as to define boundaries extending between the adjacent valley parts at respective roots of the teeth which are arcuate and convex away from the teeth, the quench hardened teeth being on one side of the boundaries and the valley parts being free from the quench hardening and being on the other side of the boundaries.

* * * * *